United States Patent [19]

Muth

[11] Patent Number: 5,007,351

[45] Date of Patent: Apr. 16, 1991

[54] MOBILE CARRIAGE WITH CENTER DRIVE

[75] Inventor: James C. Muth, Eagle, Wis.

[73] Assignee: Spacesaver Corporation, Fort Atkinson, Wis.

[21] Appl. No.: 306,540

[22] Filed: Feb. 3, 1989

[51] Int. Cl.[5] ..... B61C 9/00; B60L 13/02; A47F 3/08; A47B 53/00

[52] U.S. Cl. ..... 105/101; 104/287; 211/1.5; 238/148; 295/34; 312/198; 312/201

[58] Field of Search ..... 105/101, 102, 105, 110, 105/170; 474/101, 116, 2; 312/198-201; 238/148, 145; 211/1.5, 162, 151; 104/50, 287, 235, 172.1; 295/34, 1, 4; 16/107; 254/214

[56] References Cited

U.S. PATENT DOCUMENTS

| | | | |
|---|---|---|---|
| 336,050 | 2/1886 | Jacobs | 295/34 |
| 3,575,479 | 4/1971 | Kombuchen | 312/200 |
| 3,640,595 | 2/1972 | Staller et al. | 312/200 X |
| 4,139,154 | 2/1979 | Giroud | 238/148 X |
| 4,421,365 | 12/1983 | Taniwaki | 104/287 X |
| 4,559,027 | 12/1985 | Sattel | 474/113 X |
| 4,683,962 | 8/1987 | True | 474/101 X |
| 4,876,967 | 10/1989 | Postma | 104/287 X |

FOREIGN PATENT DOCUMENTS

| | | | |
|---|---|---|---|
| 7612065 | 10/1976 | Netherlands | 312/201 |

*Primary Examiner*—Robert J. Oberleitner

*Attorney, Agent, or Firm*—Fuller, Ryan & Hohenfeldt

[57] ABSTRACT

A mobile storage system includes mobile carriages that roll on rails embedded in a building floor. The carriages are driven along the rails by at least two flanged wheels that engage a grooved rail. The flanged wheels are preferably mounted in parallel channels located at the center of the carriages. The flanged wheels are driven in synchronization by a sprocket and chain drive. Either electric or manual power may be provided. In both cases, the sproket and chain drive is adjustable to provide proper chain tension to the wheels to improve tracking. Chain adjustment may be accomplished by an idler sprocket movably mounted to a carriage channel.

1 Claim, 5 Drawing Sheets

MOBILE CARRIAGE WITH CENTER DRIVE

BACKGROUND OF THE INVENTION

1. Field of the Invention

This invention pertains to power transmission, and more particularly to apparatus for driving tracked carriages.

2. Description of the Prior Art

Mobile storage systems for storing books, supplies, and files are well known. Such systems provide high density storage, and therefore they save valuable space in offices, schools, and libraries.

Typical mobile storage systems include two or more parallel rails embedded in or attached to a building floor. One or more relatively long and narrow carriages span the rails. The carriages may be as long as thirty feet, and the number and spacing of the rails are chosen to suit the particular carriage length. The carriages are usually supported by a pair of wheels rolling along each of the rails.

The carriages may be designed to move along the rails under manual power. For that purpose, a hand wheel is usually mounted to a carriage end panel. The hand wheel is connected by various drive components to a shaft that in turn is connected with at least one of the carriage wheels. Manually rotating the hand wheel causes the drive wheels to rotate and move the carriage. Electrically powered carriages are also in wide-spread use. With that design, a suitable electric motor is substituted for the manual hand wheel. The motor shaft is mechanically connected through a suitable mechanism to the carriage drive wheels.

It has been a common practice to design mobile carriages such that the drive wheels are located on the two ends of the carriages. That is, the carriages are driven by a wheel supported on each of the two outermost rails, and the center regions of the carriages are supported on the interior rails by non-driving wheels. In some designs, there is a driving wheel on each of the rails. Those designs require multiple locations of the drive wheels, which is undesirably expensive. Further, the prior design requires a long shaft for connecting the drive wheels on the carriage ends. The long shafts are awkward to assemble and service. In addition, the long shafts may undergo torsional wind-up when used with heavy carriages, such that the drive wheels at the carriage end remote from the electric motor or hand wheel do not rotate in synchronization with the drive wheels at the carriage hand wheel or motor end. Consequently, despite flanges on the drive wheels, the carriages can tend to skew as they are driven along the rails.

Thus, a need exists for improved driving mechanisms for mobile storage carriages.

SUMMARY OF THE INVENTION

In accordance with the present invention, an economical center drive is provided that improves the performance of mobile storage system carriages. This is accomplished by apparatus that includes components that drive the mobile carriages solely from near the centers of the respective carriages.

Each carriage of the mobile storage system is supported by conventional non-driving wheels on all the system rails except the center rail. Synchronized transversely spaced drive wheels engage the center rail or mid rail. Preferably, the drive wheels have central flanges that fit within and are guided by a longitudinal groove in the rail top surface.

To drive the carriage drive wheels in synchronization, they are provided with respective sprockets. A chain is trained around the sprockets. The chain is driven by a driver sprocket that is journaled in the carriage frame. The driver sprocket is fixed to the shaft of an electric motor or to the output shaft of a speed reducer mounted to the carriage frame proximate the drive wheels. To provide tension adjustment to the drive wheel chain, the driver sprocket bearings are received within slots in the carriage frame. Varying the position of the driver sprocket bearings within the carriage frame slots also varies the driver sprocket position and the drive wheel chain tension. In an alternate construction, the motor may be stationarily mounted to the carriage frame, with an idler sprocket movably mounted within the frame to adjust chain tension. By locating the electric motor and drive wheels at the center of the carriage, the previously required long drive shaft between the two carriage ends is eliminated. In addition, the synchronized drive wheels on the single center rail improve carriage tracking and performance.

The center drive carriage of the present invention may also be used with manually powered carriages. In that instance, a relatively short shaft is used to join the portions of the drive mechanism associated with the hand wheel to the wheel driving chain at the center of the carriage. A driver sprocket is fixed to the shaft end at the carriage center for driving the chain trained over the drive wheel sprockets. Like the electrically powered carriage, the manually driven driver sprocket is journaled in bearings that are received in slots in the carriage frame. The driver sprocket is thus adjustable to a location that produces proper tension for the drive wheels chain. In an alternate design, the driver sprocket bearings are fixedly mounted to the carriage frame, and an adjustable idler sprocket is provided to set the proper chain tension.

Other benefits and features of the present invention will become apparent to those skilled in the art upon reading the disclosure.

DETAILED DESCRIPTION OF THE INVENTION

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 1:
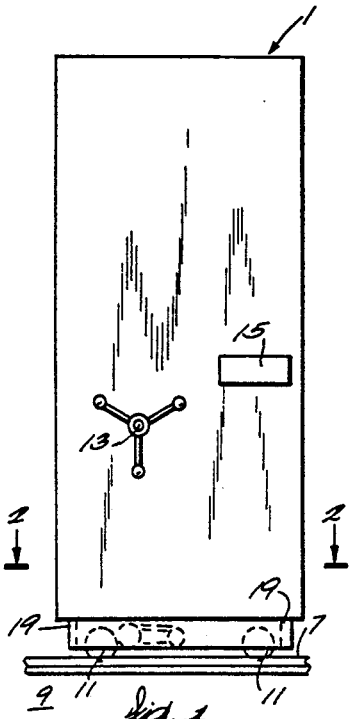
FIG. 1 is a simplified side view of a mobile storage carriage that advantageously employs the present invention.

Referring to FIG. 1, a mobile storage carriage 1 is illustrated that includes the present invention. The mobile carriage 1 is typically part of a mobile storage system that includes additional mobile carriages, as well as one or more stationary units, not shown, as are known in the art.

The mobile carriage 1 travels along two or more parallel rails 7 spaced longitudinally along the carriage length and embedded in or attached to a building floor 9. The carriage is supported on the rails 7 by respective pairs of wheels 11. Power for moving the carriage along the rails may be supplied manually. In that case, the ends of the carriage are usually furnished with a hand wheel 13. Alternately, the carriage may be designed with an electrically powered system. In that situation, the hand wheel 13 is eliminated, and a suitable electrical control, schematically represented at reference numeral 15, is substituted.

Figure 2:
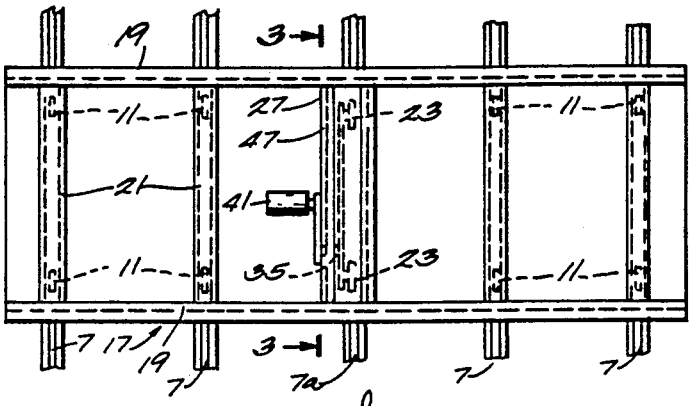
FIG. 2 is a cross sectional view taken along lines 2—2 of FIG. 1 and rotated 90° counterclockwise.

In accordance with the present invention, electrically and manually powered mobile carriages are driven along the rails 7 through synchronized wheels that engage a single mid rail. Looking also at FIG. 2, a typical mobile storage system is depicted that has five rails. The center rail is designated as reference numeral 7*a*. The frame 17 of a carriage 1 is designed with longitudinal beams 19 and with a cross brace 21 over each of the rails except the mid rail 7*a*. At least two wheels 11 are suitably journaled in each cross brace 21 for supporting the carriage on the associated rail. The mounting of the wheels to the cross braces may be by conventional components that form no part of the present invention.

Figure 4:
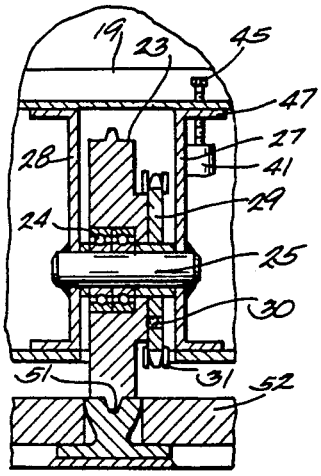
FIG. 4 is a cross sectional view taken along lines 4—4 of FIG. 3.
Figure 3:
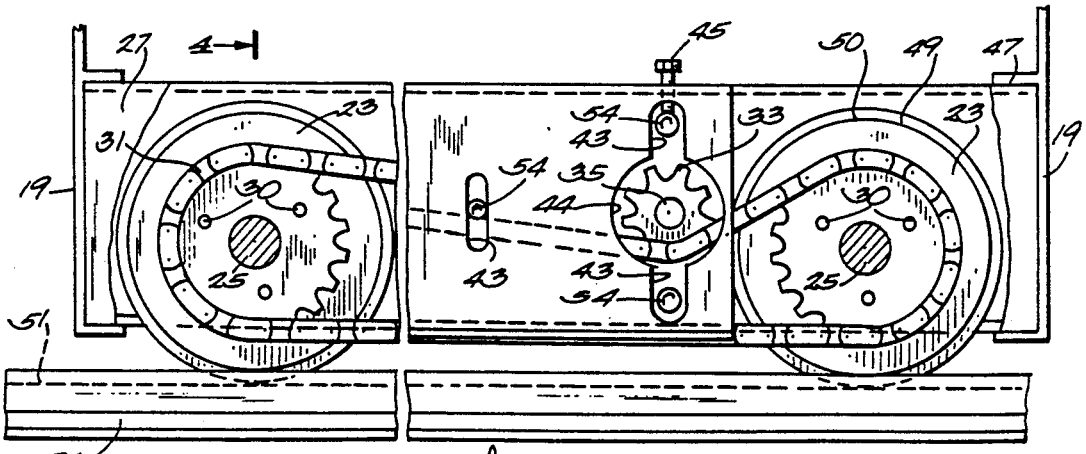
FIG. 3 is an enlarged cross sectional and partially broken view taken along lines 3—3 of FIG. 2.
Figure 5:
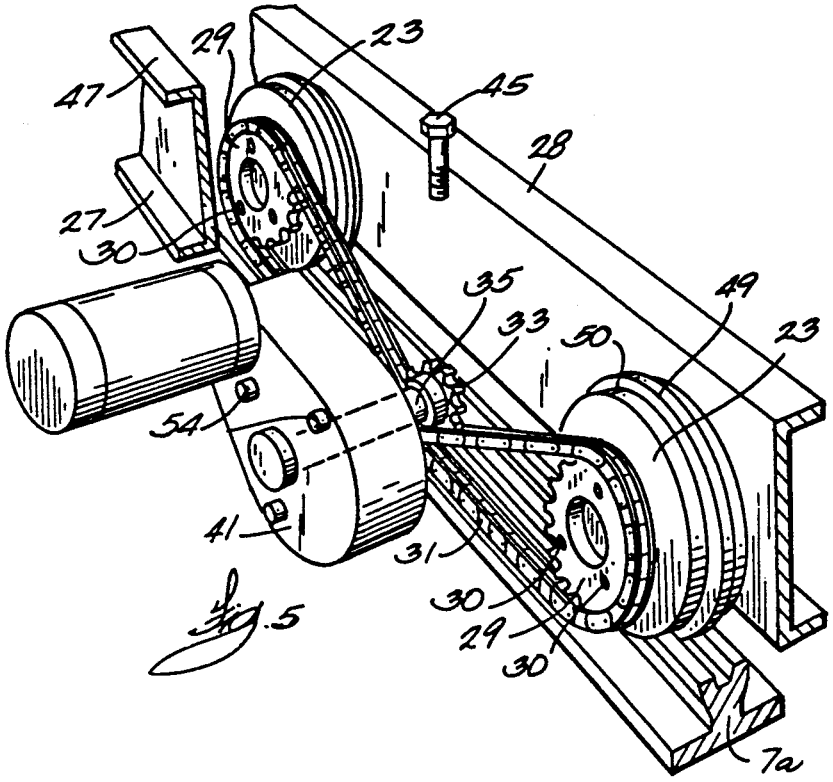
FIG. 5 is an exploded partially broken perspective view of an electrically powered drive mechanism according to the present invention.

To drive the carriage 1 along the rails 7 and 7*a*, the carriage frame 17 comprises a pair of drive wheels 23. Referring also to FIGS. 3–5, the drive wheels 23 are rotatably mounted, as by bearings 24, on respective axles 25. The axles 25 are supported between channels 27 and 28 that span the frame longitudinal beams 19. To each drive wheel is attached a sprocket 29, as by plug welds 30. Trained over the sprockets 29 is a chain 31. The chain 31 is driven by a driver sprocket 33 that is fastened to the output shaft 35 of a combination electrical motor and speed reducer 41. The motor and speed reducer 41 is mounted to the channel 27 by conventional fasteners 54 passing through vertical slots 43 in the channel.

To provide adjustability to the chain 31, adjusting screw 45 coacts between the flange 47 of the channel 27 and the motor housing 41. The adjusting screw 45 assists positioning the motor and thus the motor output shaft 35 within the channel hole 44 for applying proper tension to the chain. When the shaft 35 is in the proper location, the fasteners 54 are tightened to the channel. Actuation of the control 15 energizes the motor 41 to rotate the drive wheels 23 in synchronization and move the carriage 1 along the rails 7 and 7*a*.

To guide the carriage 1 on the rails 7 and 7*a*, each drive wheel 23 is formed with an annular flange 49 that extends concentrically from the wheel peripheral bearing surface 50. The drive wheel flanges 49 interfit within grooves 51 formed in the top surface of the rail 7*a*. In FIGS. 3 and 4, reference numerals 52 represent decorative or safety floor panels placed between the rails, as is known in the art.

Figure 8:
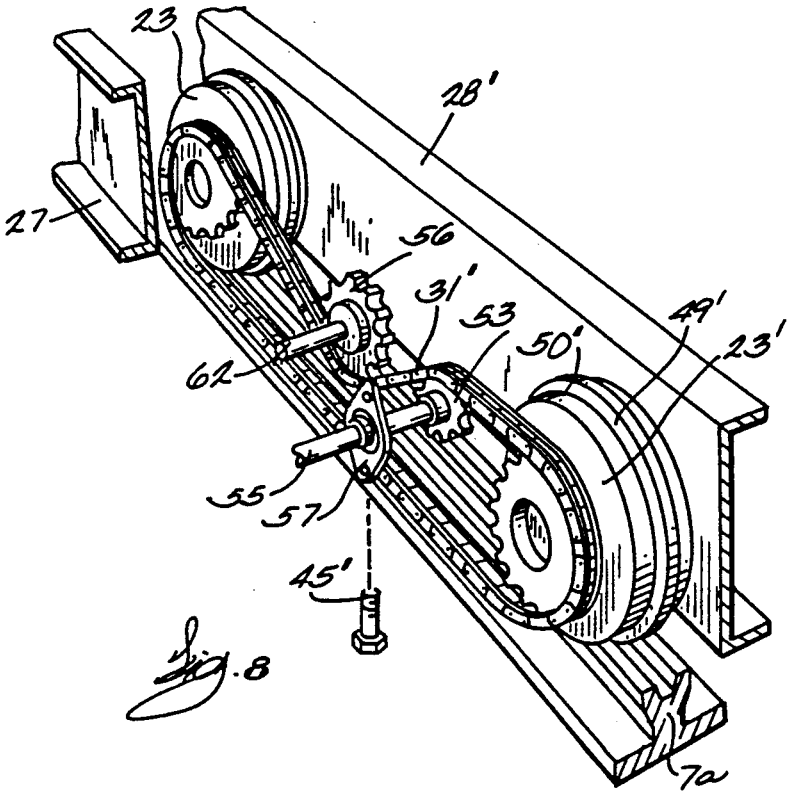
FIG. 8 is an exploded partially broken perspective view of the drive mechanism of the manually powered mobile carriage.
Figure 6:
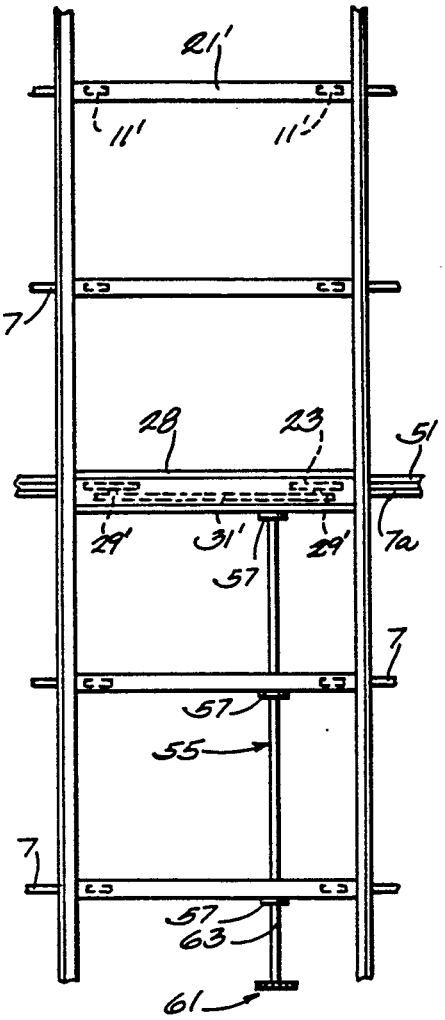
FIG. 6 is a view similar to FIG. 2, but showing a manually powered mobile carriage according to the present invention.
Figure 7:
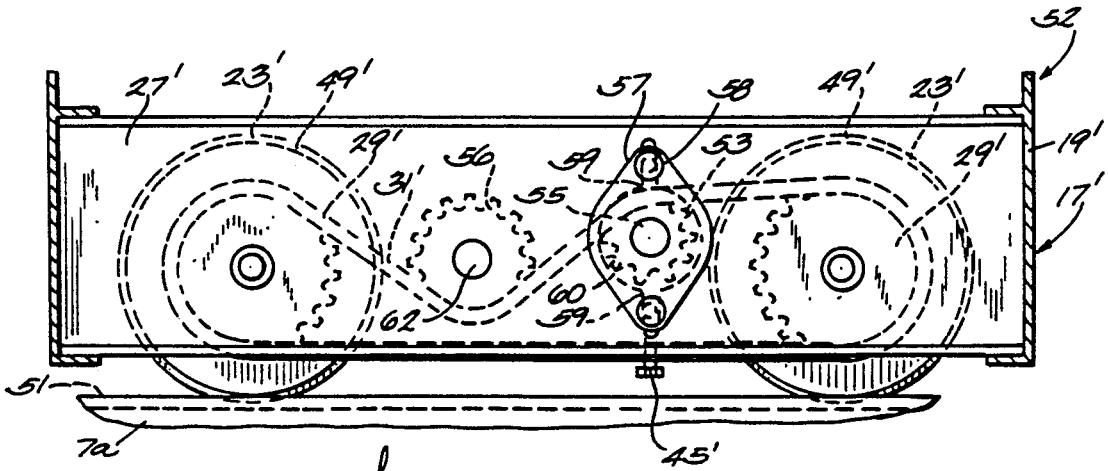
FIG. 7 is a view generally similar to FIG. 3, but showing the design of the manually operated carriage of FIG. 6.

Turning to FIGS. 6–8, a manually powered version of the present invention is illustrated. As with the electrically powered version described previously in connection with FIGS. 1–5, the manual version includes one or more carriages 52, each having a frame 17′ comprised of longitudinal beams 19′ and cross braces 21′. Support wheels 11′ are journaled to the cross braces 21′ for supporting the carriage 52 on the rails 7. The center rail 7*a* is grooved at 51 to accept the flanges 49′ of the drive wheels 23′. To each drive wheel 23′ is fixed a sprocket 29′. A chain 31′ is trained over the sprockets 29′. To drive the chain 31′, a driver sprocket 53 is fixed to one end of a shaft 55, and the chain 31′ is also trained over the sprocket 53. The shaft 55 is journaled in the carriage channel 27′ by means of a flangette bearing 57 that is movably secured to the carriage frame 17′ by conventional fasteners 58 passing through channel slots 59. The drive for the manual mobile carriage 52 further comprises an idler sprocket 56 for the chain. The idler sprocket 56 is mounted for rotation on suitable bearings supported by a stub shaft 62 that is fixed to the channel 27′. The flangette bearing 57 is adjustably positionable relative to channel hole 60. Adjusting screw 45′ coacts between the channel 27′ and the flangette bearing to aid adjusting the flangette bearing and thus the shaft 55 to provide variable tension to the chain 31′.

The manually powered carriage 52 is driven through a hand wheel 13, which is connected to the second end 63 of the shaft 55 by any suitable means, such as a chain and sprocket mechanism 61. In that manner, the manual center drive carriage can be operated with a drive shaft that is only approximately one-half as long as previously required.

Figure 9:
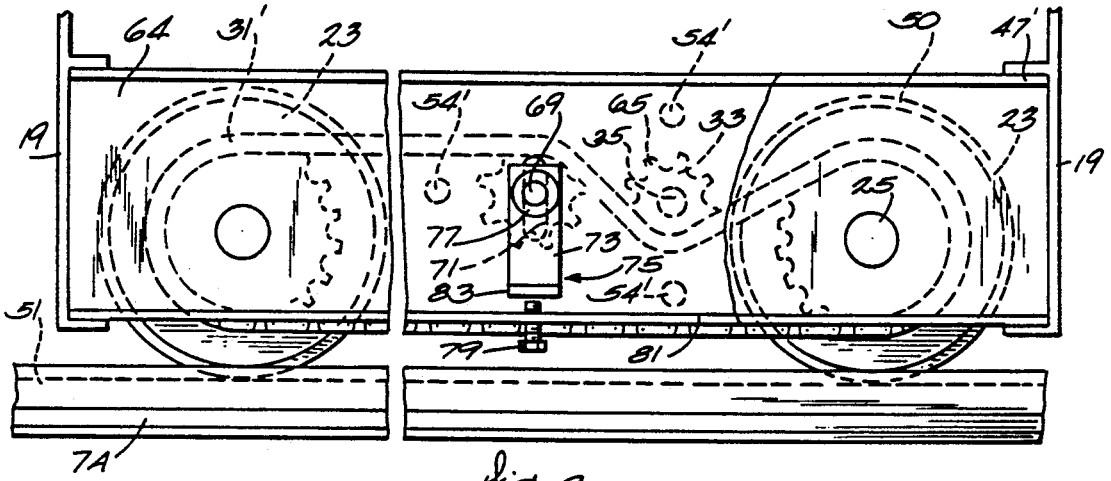
FIG. 9 is a view similar to FIG. 3, but showing an alternate construction of the present invention.
Figure 10:
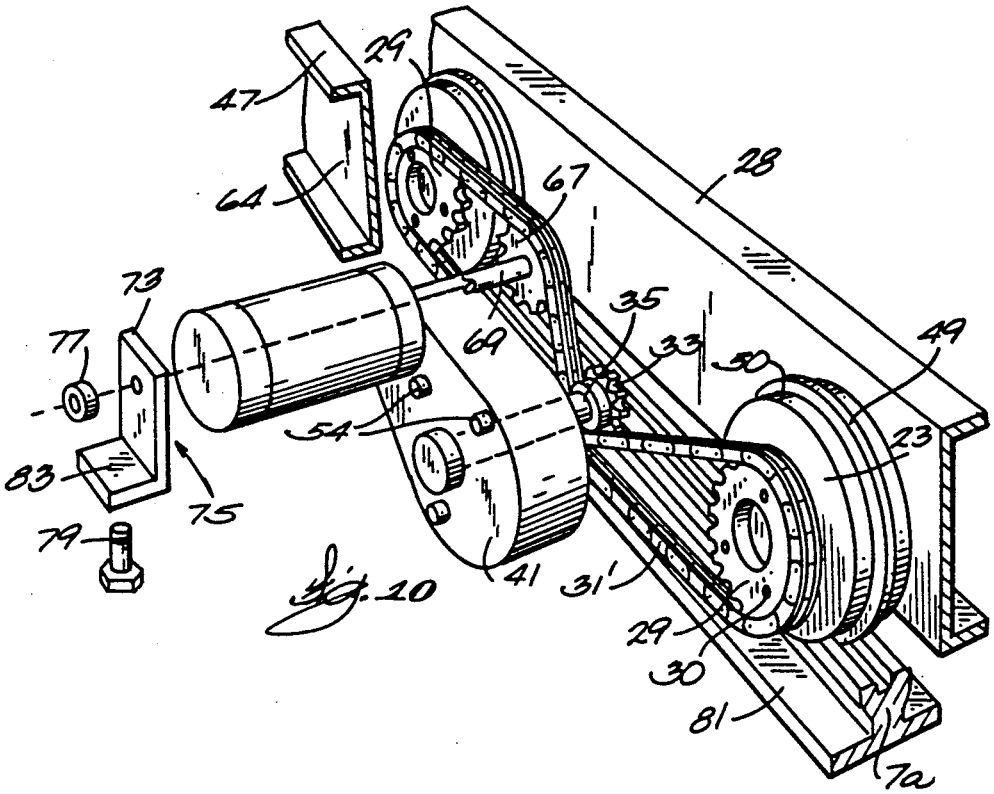
FIG. 10 is a partially broken perspective view of the carriage drive of FIG. 9.

Now looking at FIGS. 9 and 10, an alternate construction of an electrically powered mobile carriage is illustrated. The speed reducer 41 is fixedly mounted to the carriage channel 64 by screws 54′. A hole 65 is provided in the channel 64 for passage of the driver sprocket 33, but there are no adjustment slots for the screws 54′. To adjust the tension of the drive chain 31′, an idler sprocket 67 is slidably mounted to the channel 64. The idler sprocket 67 is supported on a short shaft 69 by a conventional bearing, not shown. The shaft 69 passes through a vertical slot 71 in the channel 64. The shaft 69 may be fixed to one leg 73 of a right angle plate 75 by a collar 77. An adjustment screw 79 is threaded through the longitudinal flange 81 of the channel 64 to contact the second leg 83 of the plate 75. By turning the screw 79 within the channel flange 81, the plate 75 forces the sprocket shaft 69 and the idler sprocket 67 to slide within the channel slot 71, thereby altering the tension of the chain 31′. The remaining components of the design of FIGS. 9 and 10, including the drive wheels 23 and sprockets 29, are the same as for the design described previously with respect to FIGS. 2–5.

Figure 11:
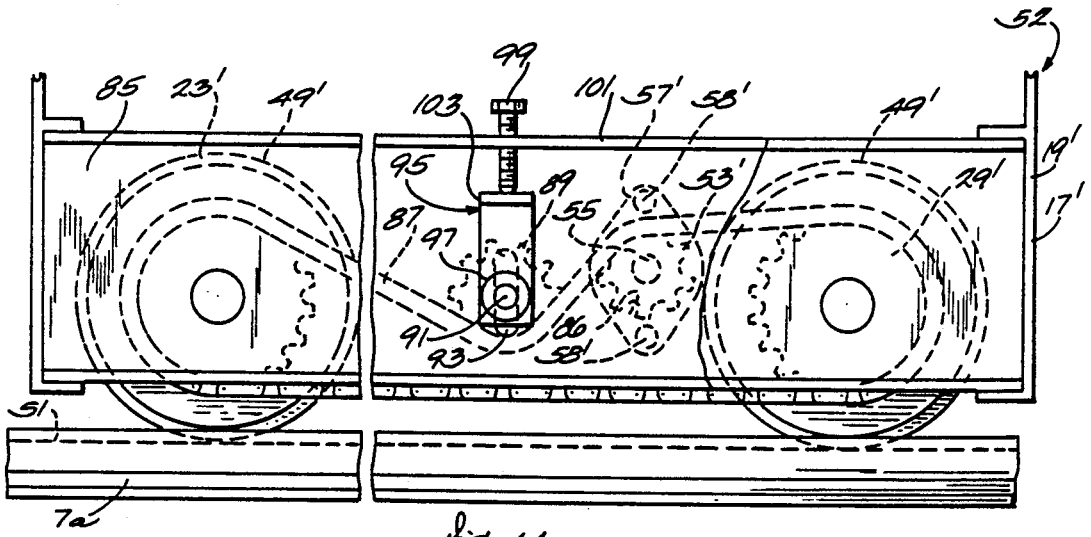
FIG. 11 is a view generally similar to FIG. 9, but showing an alternate design of a manually powered mobile carriage according to the present invention.
Figure 12:
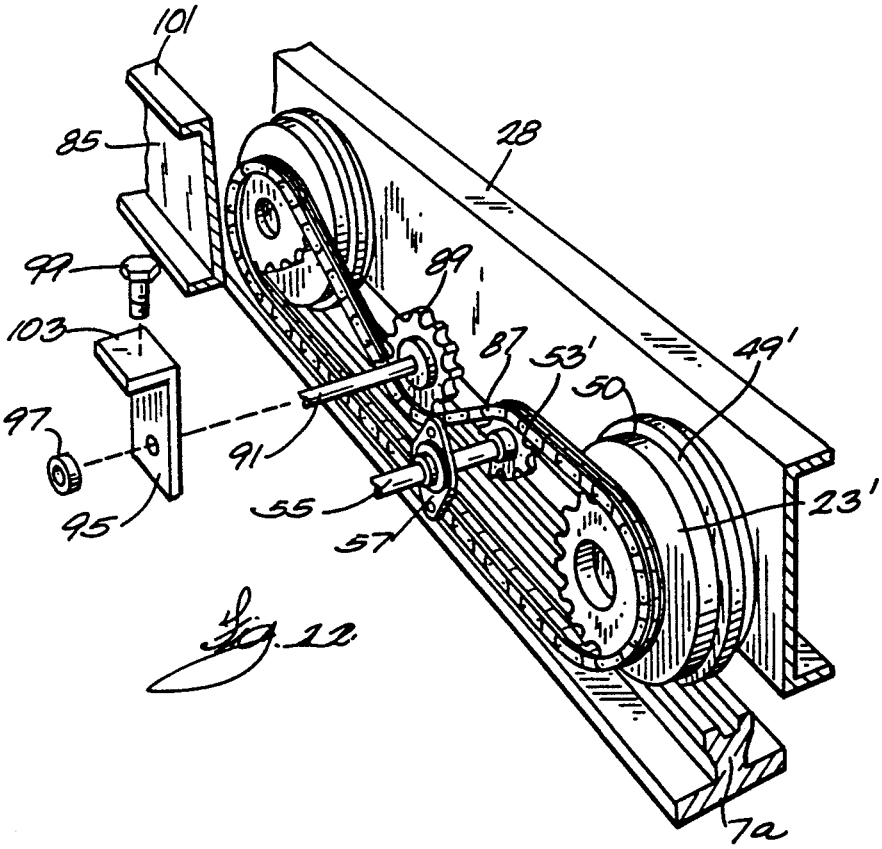
FIG. 12 is an exploded partially broken perspective view of the manually powered carriage drive of FIG. 11.

The manually powered mobile carriage as previously described in connection with FIGS. 6–8 may also have an alternate construction. In FIGS. 11 and 12, the flangette bearing 57' is fixedly secured to the carriage frame channel 85 by fasteners 58'. An opening 86 is cut in the channel 85 for the driver sprocket 53'. Tension adjustment of the drive chain 87 is achieved by an idler sprocket 89 mounted for rotation on a short shaft 91. The shaft 91 passes through a slot 93 in the channel 85 and is fastened to a right angle plate 95 as with a collar 97. The plate 95 and shaft 91 are slidably captured to the channel 85. An adjustment screw 99 threaded into the flange 101 of the channel 85 bears against a leg 103 of the right angle plate 95. Turning the screw 99 against the plate leg 103 adjusts the tension of the chain 87 by causing the idler sprocket and shaft 91 to slide in the channel slot 93. The remainder of the alternately constructed manually powered mobile carriage is substantially similar to that described previously in conjunction with FIGS. 6–8.

Thus, it is apparent that there has been provided, in accordance with the invention, a center drive mobile carriage that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications and variations as fall within the spirit and broad scope of the appended claims.

I claim:

1. A center drive mobile carriage system comprising:

a. a pair of spaced and parallel end rails fixed to a support surface;

b. at least one intermediate rail fixed to the support surface and located parallel to and between the pair of end rails, the intermediate rail being formed with a longitudinal groove therein;

c. at least one carriage supported on the end and intermediate rails for moving therealong, the carriage comprising:

i. an elongated frame that spans the end rails;

ii. first wheel means for supporting the carriage on the end rails;

iii. a pair of second wheels mounted to the carriage for supporting the carriage on the intermediate rail, each second wheel having a flange that engages the groove in the intermediate rail and a sprocket; and iv. a chain trained around the two second wheels; and d. drive means for moving the carriage along the rails, the drive means comprising:

i. a source of power mounted to the carriage frame and having an output shaft;

ii. a power sprocket connected to the power source output shaft and meshing with the carriage chain; and iii. adjustment means for changing the location of the power source output shaft and power sprocket on the carriage frame to thereby adjust the tension of the carriage chain.

* * * * *